United States Patent [19]

Hawkins

[11] Patent Number: 4,570,810

[45] Date of Patent: Feb. 18, 1986

[54] CAP WITH TAMPER INDICATING BAND

[75] Inventor: Gene Hawkins, Evansville, Ind.

[73] Assignee: Sunbeam Plastics Corporation, Evansville, Ind.

[21] Appl. No.: 712,379

[22] Filed: Mar. 15, 1985

[51] Int. Cl.[4] ..... B65D 41/32

[52] U.S. Cl. ..... 215/253

[58] Field of Search ..... 215/253, 254, 256, 274

[56] References Cited

U.S. PATENT DOCUMENTS 4,228,909 10/1980 Lecinski ..... 215/253

*Primary Examiner*—Donald F. Norton

*Attorney, Agent, or Firm*—Fisher, Crampton, Groh and McGuire

[57] ABSTRACT

A closure for a bottle comprises a tamper indicating band and a cap which is connected to the band in such a manner that the cap cannot be removed until the band is broken.

The band provides a permanent tamper indication in that once it is broken, it cannot be restored to its original condition.

14 Claims, 10 Drawing Figures

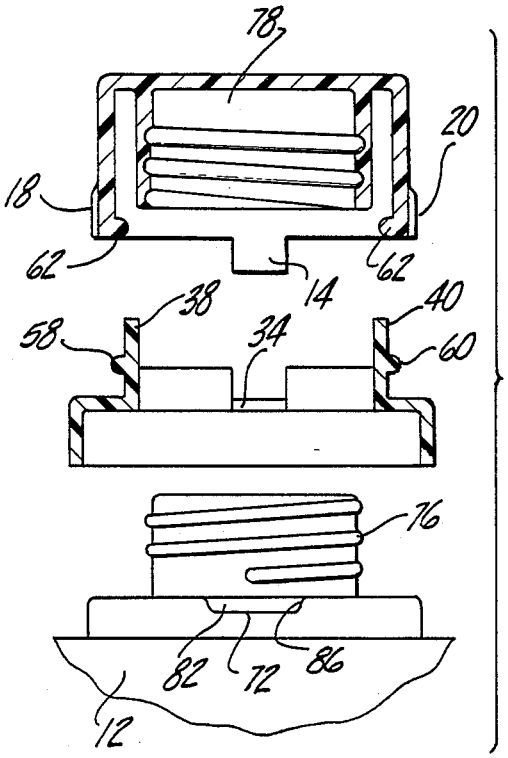
Fig-8
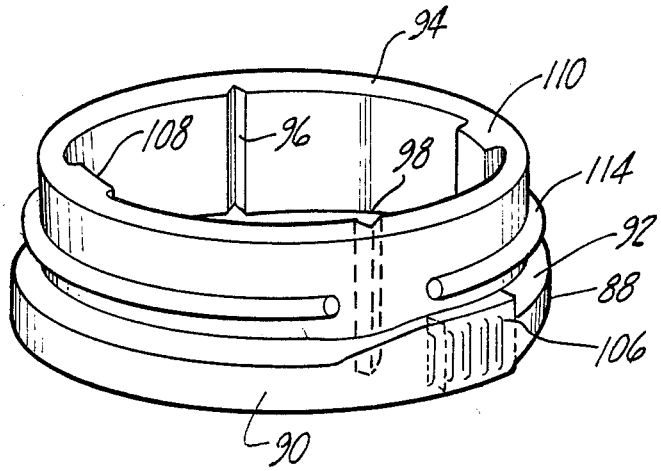
Fig-9
Fig-10
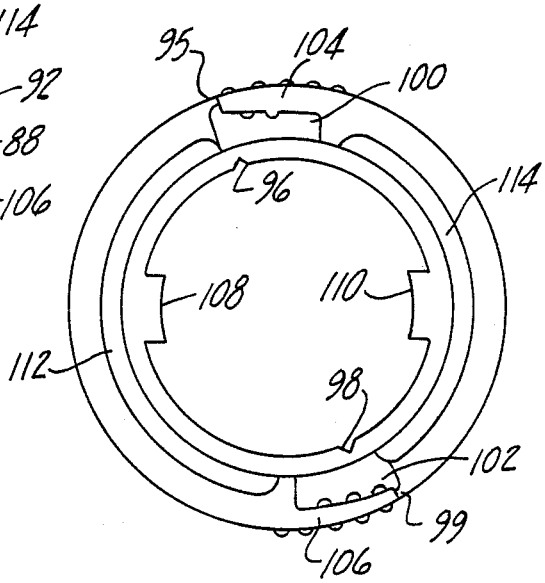

CAP WITH TAMPER INDICATING BAND

This invention relates to closures for containers and more particularly to closures of the type which indicate tampering.

There are a large variety of closures for containers which are intended to give evidence that a container has been opened or at least placed in a condition for opening once it has been filled. The purpose of such closures is to insure that consumers can be confident that a closure has remained in a closed position and not been open prior to its purchase.

It is a general object of this invention to provide a tamper indicating closure which does not require a special container and therefore can be used with a wide variety of containers of standard configuration.

Another general object of the invention is to provide a tamper indicating closure arrangement whereby the closure cannot be breached or opened without a permanent indication being formed indicating that there has been an opening whether that opening was for tampering or for a legitimate purpose.

A further object of the invention is to provide a tamper indicating closure arrangement useful for capping bottles and similar containers which provides for easy manufacture and assembly.

Another object is to provide a container locking cap and a tamper indicator which can be made as two separate elements then assembled and thereafter applied to a container.

A still further object of the invention is to provide a container cap tamper indicating arrangement wherein different materials and colors can be used for the cap than for the tamper indicator. For example, the tamper indicator can be made of material such as a low density polyethylene of one color, and the cap can be made of a more elastic material such as polypropylene, and of a different color.

Still another object of the invention is to provide a container cap tamper indicating system in which tamper indicating portions thereof must be fractured in order to open the container, and once that has occurred the tamper indicating portion or device cannot be reset in such a manner as to deceive a prospective user.

It is yet still another object of the invention to provide a tamper indicator for a container cap wherein the tamper indicating device or portion must be completely removed in order to open the locking container cap.

It is still another object of the invention to provide a container cap with a tamper indicating band which can be used without any modification to the ordinary bottles which had heretofore been closed by such container caps.

These and other objects of the invention will become apparent from the following description and the accompanying drawings in which the present preferred embodiments are illustrated and in which:

FIG. 8 is a fragmentary partly sectioned exploded elevational view of a bottle of a known type and a cap and band according to the invention;

FIG. 9 is a perspective view of another embodiment of a band according to the invention; and FIG. 10 is a top plan view of the band of FIG. 9.

Figure 1:
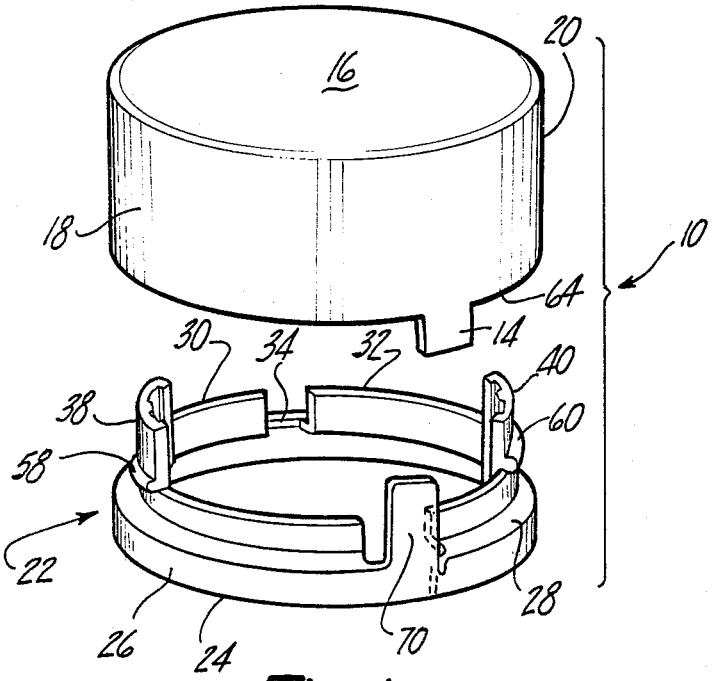
FIG. 1 is a perspective view of a cap and band according to the invention.
Figure 2:
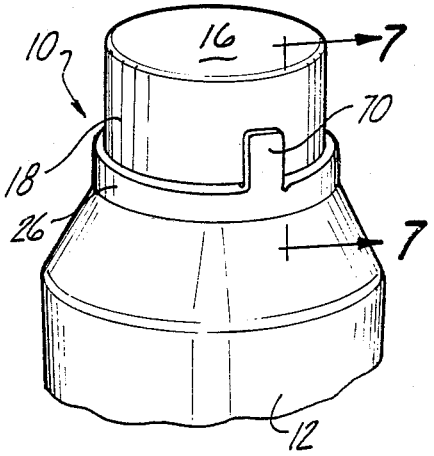
FIG. 2 is a fragmentary perspective view of the cap and band of FIG. 1 in position on a typical bottle.

In FIGS. 1 and 2, a tamper indicating band and container locking cap combination 10, according to the invention, are shown as applied to the top of a typical bottle 12 such as might be used for containing medicine. As is known in the art, the bottle 12 is also provided with tab receiving slots, not shown in FIG. 2, but see FIGS. 3 and 8, which are adapted to receive tabs such as 14 on the cap 16. The cap 16 must be squeezed at locations 18 and 20 which are approximately diametrically normal to the tabs 14 in order to remove the cap from the bottle. When this is done, the cap will deform with the squeezed portions 18, 20 being forced inwardly and the tabs 14 as a reaction, moving outwardly from the tab slots or locks in the bottle. With this accomplished, the cap can simply be removed from the top of the bottle. Where mating threads are provided on the bottle and the cap the cap can be rotated off of the bottle. According to the invention, a tamper indicating band 22, see FIGS. 1 through 6, is used in association with the cap 16 to form a tamper indicating cap-band combination for the bottle 12. The band 22, see particularly FIGS. 3 and 4, has a base member 24 formed of a skirt 26, a horizontal platform section 28 and a pair of vertically extending sleeves 30 and 32 extending upwardly from the inner periphery of the base member 24. The ring-like base member 24 as well as the cap 16, are chosen of a particular size suitable for the bottle which is to be closed and the ring-like base member closely fits the neck of such a bottle, see FIG. 8 for example.

A pair of diametrically opposed radially extending vertical slots 34 and 36 are formed in the platform section 28 and extend upwardly between the two sleeves 30 and 32, thus defining the extent of the latter sleeves and their separation from each other. The slots extend vertically completely through the base member and are selected so as to be in alignment with suitable locks or slots on the bottle of the type well known to those skilled in the art.

The tamper indicating band is provided with a pair of diametrically opposed blocking and stiffening areas 38 and 40 within the sleeves 30 and 32 and preferably as shown in the drawings extending upwardly from the sleeves. These stiffening means are positioned normal to the slots 34 and 36, see FIGS. 1 and 3 through 5. The blocking and stiffening sections include vertically extending ribs 42, 44, and 46 and 48, 50 and 52, respectively, in addition to the portions 54 and 56 which extend upwardly from the sleeves 30 and 32, respectively. In addition, there are beads 58 and 60 provided on the exterior surfaces of the sleeves 30 and 32, respectively. These beads are parallel to the horizontal platform section 28 and positioned substantially adjacent the upper edges of the sleeves 30 and 32, see also FIG. 7.

Figure 7:
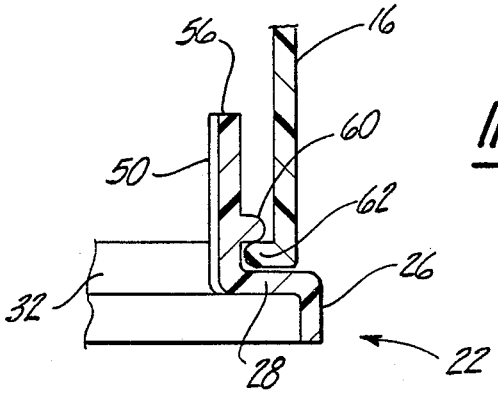
FIG. 7 is a fragmentary vertical section taken generally along 7—7 of FIG. 2 with some parts deleted for clarity.

The cap 16 has a pair of beads 62, see FIGS. 7 and 8, positioned diametrically opposite each other and arranged normal to the tabs 14, see FIG. 7, and adjacent the lower end of the skirt 64 of the cap. The beads 62 extend parallel to the lower edge of the skirt 64. The elements are sized so that the cap can be snapped over the sleeves of the ring with the tabs 14 received between the two upstanding sleeves 30 and 32 and being spaced within the slots 34 and 36 when the two elements, the cap and the band are assembled prior to being associated with the bottle. Slight distortion of the cap is necessary in order to achieve this. The size of the respective elements is such that the skirt of the cap will be substantially adjacent, if not in contact with the horizontal platform section 28 of the band with the two beads 62 beneath the beads 58 and 60. Once the cap and the ring are arranged as shown in FIG. 7, the cap 16 cannot be removed from the band since the sleeves 30 and 32 fit too closely to the inner periphery of the cap skirt to accommodate the distortion that would be necessary to swing the cap skirt outwardly beyond the ring beads 58 and 60. At the same time, the tabs 14 will extend downwardly within the slots 34 and 36. The cap is made of material which is relatively flexible and the tabs 14 can flex. However, the skirt 64 of the cap cannot flex sufficiently, as stated above, to permit the removal of the cap from the band.

The band can only be removed by compressing it inwardly with respect to the cap. Since the band comprises a continuous base member, the only way the band can be removed is by breaking it. For this reason, a reduced section; i.e., a frangible portion or location is provided in the band. In the preferred form shown, this is done by deleting the horizontal platform section 28 at the location 66 in the base member. This leaves only the skirt section 68. This section is at the edge of the slot 36, see FIGS. 3 through 6. A tear tab 70 is attached to the skirt 26 immediately adjacent the frangible section. This tear tab extends sufficiently upward to give adequate purchase for fracturing the ring by simply grasping the tear tab and pulling outwardly and downwardly. Once the skirt section breaks, the band can then be collapsed inwardly and removed downwardly from the cap.

Figure 3:
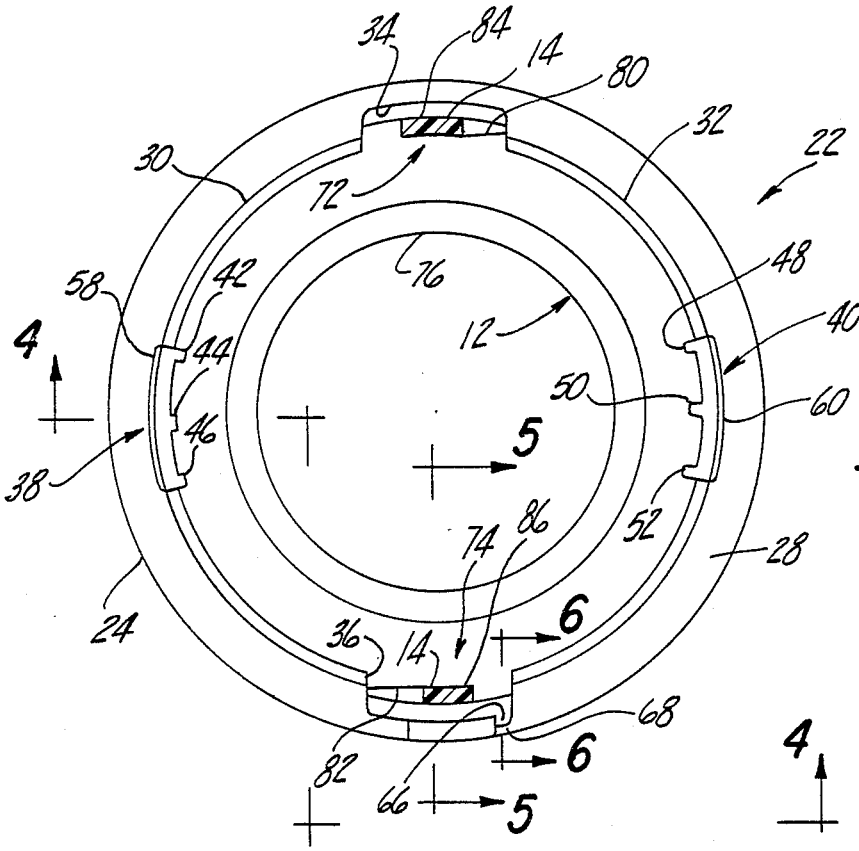
FIG. 3 is a top plan view of the tamper indicating band and a bottle and sectional cap tabs associated therewith.
Figure 4:
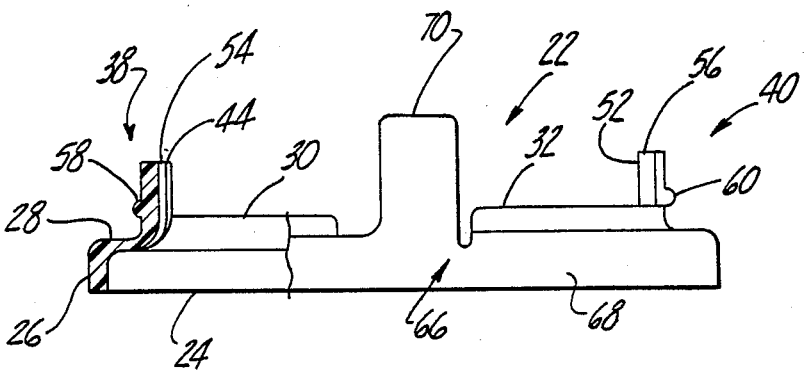
FIG. 4 is a partially sectioned elevational view of the band of FIG. 3 taken along line 4—4 of FIG. 3.
Figure 5:
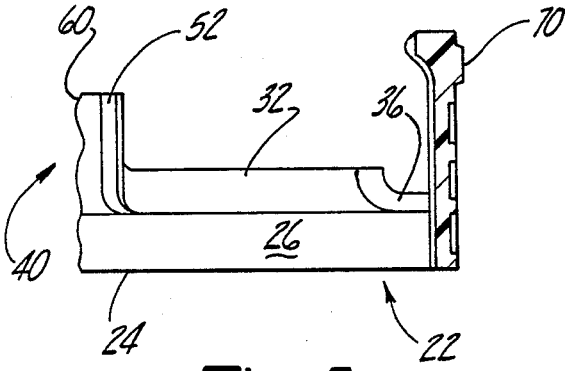
FIG. 5 is a sectional view taken along line 5—5 of FIG. 3.
Figure 6:
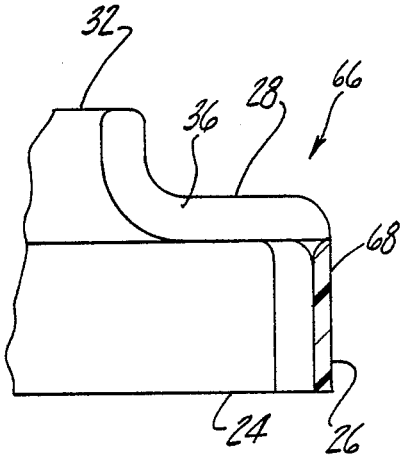
FIG. 6 is a sectional view taken along line 6—6 of FIG. 3.

As shown in FIG. 3, the slots 34 and 36 are sized sufficiently to accommodate the tabs 14 and also so that the tabs 14 can project downwardly through the slots and engage the bottle locks 72 and 74; see also FIG. 8. As shown in FIG. 8, the bottle and cap can have the typical threaded necks 76 and 78 by which the cap is rotated onto the bottle in order to close it, and a seal can also be provided as is known in the art. The bottle locks are formed by indentations in the bottle. As is further known in the art, the tabs 14 on the cap will ride upon the ramps 80 and 82 of bottle locks 72 and 74 as the cap is rotated clockwise to a locking position. The buttresses 84 and 86 project radially outwardly of their locks and the tabs cannot clear the buttresses by simply rotating the cap counter clockwise. The cap can now be only rotated counter clockwise upon squeezing the cap at locations substantially normal to the tabs. When this is done, the cap flexes and the tabs are moved outwardly within the locks. The cap can then be rotated counterclockwise. As explained above, with the locking band in position, it is impossible to squeeze the skirt of the cap sufficiently to move the tabs of the cap outwardly beyond the buttresses 84 and 86 formed at one end of the bottle locks 72 and 74. With the tabs 14 in the position indicated in FIG. 3, it is necessary to break the locking band and remove it before the cap can be operated in the usual manner. The band is pulled downwardly out from the cap after it is fractured and then the cap can be used in the customary manner.

Obviously, once the band is removed, it is broken and can no longer be used without displaying an obvious indication that the bottle has been tampered with.

FIGS. 9 and 10 show another form of the invention. In this form, the band has a base member 88 having a skirt 90, a horizontal platform section 92 and a sleeve 94 which extends completely around the platform section on the inner periphery thereof. In this form, a frangible web 95 is provided in the skirt 90 as in the form shown in FIG. 3 but in addition, a frangible section 96 is provided through the upstanding sleeve. This band, in fact, has two frangible areas; a second one 98–99 being provided in the sleeve 94 and adjacent skirt 90 at 180 degrees from the first. The two frangible sections 96, 98 are respectively in alignment with the slots 100 and 102 in the horizontal platform section 88. Likewise, a pair of tear tabs 104 and 106 are provided adjacent each of their respective frangible sections. In this form of the invention, by virtue of the sleeve being continuous it is preferable to break the ring at two locations in order to facilitate removal. The sleeve is further provided with the reinforcing sections 108 and 110 and the beads 112 and 114 which prevent inward deformation of the cap, in the same manner as described with respect to the form of the invention shown in FIGS. 1 through 8, until the band is fractured.

According to the invention, a tamper indicating band-cap combination is provided which embodies two elements which can be separately formed and then easily attached to each other. The elements, once attached, can then be applied to the typical bottle having an opening to be closed by a cap as a single unit. Once the bottle is sealed by the cap, the cap cannot be removed without there being an indication that there has been a tampering or opening of the bottle. Thereafter, that is after the bottle has been opened for use for which it is designed, the cap can be used continuously to open and close the bottle to receive additional portions of its contents or for other purposes. The tamper indicating feature, however, will have operated to the extent where it cannot be altered or re-established. Once the indication is given that there has been a tampering or opening, that indication will always be apparent.

One of the features of the invention is that the cap, and the indicating ring-band structure, can be separately formed of different materials. The cap can be of a relatively flexible material which can be distorted in the usual manner for releasing tabs from bottle locks and/or for re-engagement of the tabs with the bottle locks. On the other hand, the ring-band which serves to give the tamper indicating feature can be formed of a very different material, one that would be relatively, compared to the cap, more rigid and subject to being fractured upon the application of pressure to a weakened point on the band. The cap and band can be made in different colors as well. Another feature of the invention is that the cap and the tamper indicating band can be joined prior to association with the bottle and thus can be available as a unit. The design is such that the cap and the band will provide a stable base for resting the combined unit whereas the cap alone will rock upon the tabs and cannot be readily stacked, for example.

While several embodiments of the tamper indicating band and cap have been disclosed, which will give a clear indication whether a bottle has been tampered with or opened for any reason, it will be understood by those skilled in the art that the invention may take other forms and that the invention is limited only by the scope of the claims appended hereto.

The embodiments of the invention in which an exclusive property or privilege is claimed are defined as follows:

1. A tamper indicating band for a container cap having locking tabs and squeeze sections normal to said tabs, said band comprising: a ring-like base member having an inner periphery shaped to conform to the outer periphery of a portion of a container to be closed, said band being adapted to cooperate with a container cap to close such a container, said band including means forming a pair of diametrically opposed radially extending vertical slots in said ring-like base member sized to receive a pair of mating tabs on a said container cap, a frangible section in said band extending through said ring-like base member, and a tear tab affixed to said band for applying manual force to break said band at said frangible section.

2. The band of claim 1 wherein said pair of slots extends vertically completely through said base member.

3. The band of claim 1 including a sleeve extending upwardly from said ring-like base member adjacent said inner periphery thereof, with said slots extending radially outwardly from said sleeve, said sleeve being sized to abut the interior periphery of a container cap received on said band.

4. The band of claim 1 including means stiffening said band transversely thereof and diametrically of said band along portions of said band substantially normal to said diametrically opposed slots.

5. The band of claim 4 including a ring-like band bead extending along said band at least at each of said portions and forming a part of said stiffening means.

6. The band of claim 1 including a pair of sleeves extending upwardly from said base member adjacent the inner periphery thereof, said sleeves respectively extending at least along a portion of said band substantially normal to said diametrically opposed slots and being spaced from each other tangentially of said band at said frangible section.

7. The band of claim 6 including said sleeves being spaced from each other at both said pair of diametrically opposed vertical slots.

8. The band of claim 6 including means stiffening both said sleeves transversely of said band at locations substantially normal to said diametrically opposed vertical slots.

9. The band of claim 8 including a ring-like bead extending outwardly along the exterior surface of each of said sleeves, each said bead forming part of said means stiffening said sleeves.

10. In combination, a tamper indicating band for a container cap having locking tabs and sections normal to said tabs adapted to be squeezed to distort said cap for removal from a container, and a container cap, including: said band having a ring-like base member having an inner periphery shaped to conform to the outer periphery of a portion of a container to be closed, said band having a pair of diametrically opposed radially extending vertical slots, a frangible section in said band extending through said ring-like base member and a tear tab affixed to said band for applying manual force to break said band at said frangible section, said cap having a depending skirt, a pair of diametrically opposed tabs extending downwardly from said depending cap skirt aligned in position with said slots in said band, said band having a portion received within said cap skirt substantially adjacent to and facing the inner periphery of said cap skirt and preventing inward diametrical distortion of said inner periphery of said cap skirt.

11. The tamper indicating band and container cap of claim 10 including said slots in said band extending vertically completely through said band.

12. The tamper indicating band and container cap of claim 10 wherein said portion of said band received within said cap skirt comprises a sleeve extending upwardly from said ring-like base member, said sleeve comprising a means reinforcing and stiffening said sleeve vertically along portions thereof positioned normal to the diametrical line extending through said pair of tabs of said cap.

13. The tamper indicating band and container cap of claim 10 wherein said portion of said band received within said cap skirt comprises a pair of sleeves with said pair of sleeves extending upwardly from said ring-like base member, said pair of sleeves facing each other and respectively at least extending along portions of said ring-like base member extending substantially normal to said diametrically opposed slots, said sleeves having stiffening means along the latter extending portions of said sleeves, respectively.

14. The tamper indicating band and cap of claim 10 including a bead on said band extending parallel to said ring-like base member and positioned above the latter along said portion of said band received within said cap skirt, said cap skirt having a bead extending along the inner periphery thereof spaced upwardly from the lower edge of said sleeve a distance less than the distance of said bead on said band from said ring-like base member, said cap sleeve being mounted on said band with said lower edge of said cap sleeve being closely adjacent said ring-like base member and said bead on said band being above and projecting radially outwardly over said bead on said cap skirt.

* * * * *